United States Patent [19]

Krautz

[11] 4,134,186

[45] Jan. 16, 1979

[54] SAFETY BELT FASTENING

[75] Inventor: Kurt Krautz, Rosengarten, Fed. Rep. of Germany

[73] Assignee: Stakupress Gesellschaft fur Stahl-und Kunststoffverarbeitung mbH & Co., KG, Norderstedt, Fed. Rep. of Germany

[21] Appl. No.: 771,896

[22] Filed: Feb. 25, 1977

Related U.S. Application Data

[63] Continuation-in-part of Ser. No. 717,710, Aug. 25, 1976, abandoned.

[51] Int. Cl.[2] ..... A44B 11/26

[52] U.S. Cl. ..... 24/230 A

[58] Field of Search ..... 24/230 A

[56] References Cited

U.S. PATENT DOCUMENTS

| | | | |
|---|---|---|---|
| 854,196 | 5/1907 | Brown | 24/230 A |
| 3,467,046 | 9/1969 | Welton | 24/230 A |
| 3,514,821 | 6/1970 | Saxmark | 24/230 A |
| 3,523,341 | 8/1970 | Spires | 24/230 A |
| 3,568,268 | 3/1971 | Cunningham | 24/230 A |
| 3,579,750 | 5/1971 | Carbon | 24/230 A |
| 3,593,389 | 7/1971 | Nygren | 24/230 A |
| 3,597,811 | 8/1971 | Cunningham | 24/230 A |
| 3,693,221 | 9/1972 | Cunningham | 24/230 A |
| 3,871,090 | 3/1975 | Romanzi | 24/230 A |

FOREIGN PATENT DOCUMENTS

| | | | |
|---|---|---|---|
| 1938779 | 2/1970 | Fed. Rep. of Germany | 24/230 A |
| 2107661 | 8/1972 | Fed. Rep. of Germany | 24/230 A |

*Primary Examiner*—Bernard A. Gelak

*Attorney, Agent, or Firm*—Arnold, White & Durkee

[57] ABSTRACT

A safety belt fastening in which the male member includes an enlarged head for laterally pivoting a spring biased locking member operating in a recess of at least one of two plates joined to form the female member of the fastening. The locking member moves to a position aligned substantially with the insertion movement of the head until the head passes. A guide surface including a pin in the female member laterally displaces the male member at an incline to cause pivotal rotation of the locking member during insertion, thereby effecting a force economy compared with that effected by a straight in insertion. When the locking member rotates, it pivots about its rear face in conjunction with an oppositely aligned recess face in a bearing-like action, at least one of these faces being convex. Preferably, the rear face of the locking member is made of drawn steel. The locking member is manually rotatable for release. An injector spring separates the male and female members at the time of release.

19 Claims, 9 Drawing Figures

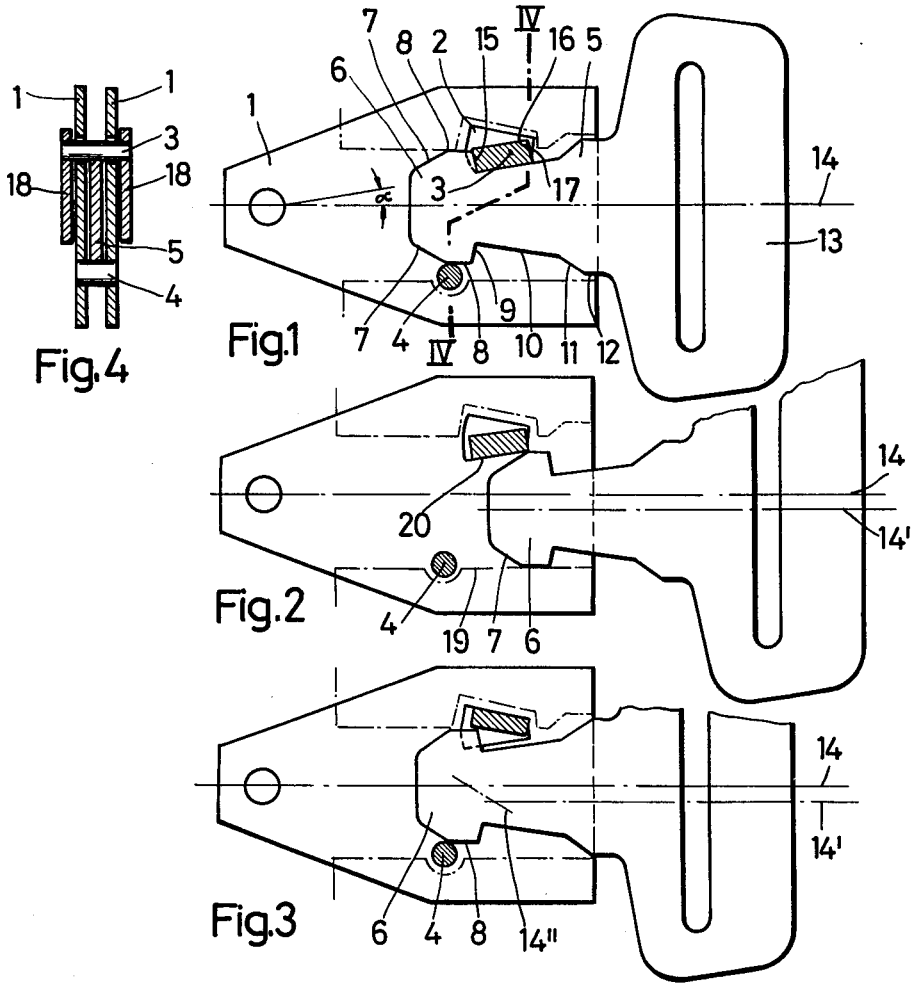
1
1
3
18
18
5
4
Fig.4
7
8
2
15
IV
16
5
6
1
3
17
14
13
α
9
7
4
IV
8
10
11
12
Fig.1
14
20
14'
4
19
7
6
Fig.2
14
14'
6
4
8
14"
Fig.3
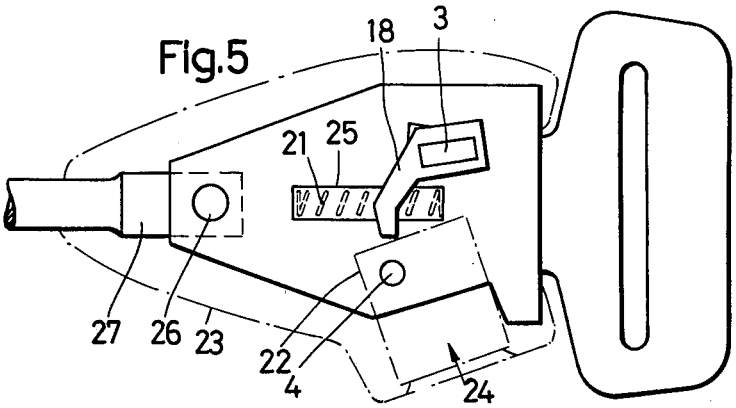
Fig.5
18
3
21
25
27
26
23
22
4
24

SAFETY BELT FASTENING

This application is a continuation-in-part of application Ser. No. 717,710, filed Aug. 25, 1976, now abandoned, of the same inventor.

The invention relates to a safety belt fastening comprising a male member formed with lateral recessing and a female member which is adapted to receive the male member and in which the same is guided between two plates and which receives a pivoted locking member cooperating with the recessing, the locking member being pivotable about a pivot perpendicular to the plates. The locking member is retained in two recesses disposed flush with one another in the plates and is spring-biased into the guide for the male member. Disposed between the plates on the side remote from the locking member are stationary guide parts which cooperate with the male member side surfaces and which provide for the male member, in that position thereof in which the same is lockable in the female member, a guiding direction coinciding substantially with male member length.

In a fastening of the kind described which is known from prior public use and which is similar to the disclosures of German Offenlegungsschrift 2,037,316 and German Utility Model 6,802,313, the path on which the male member is introduced or pushed into the female member is straight. Consequently, the guide surface opposite the locking member is straight and extends parallel to the length of the male member. Extending parallel thereto is the boundary of such path on the locking-member side, from which path the locking member must be pivoted out to release the male member. Consequently, the locking-member part adapted to drop into the recessing must make a movement transversely to the direction of the male member, the extent of such movement being at least as great as the depth to which the locking member penetrates into the recessing. The angle of pivoting depends upon such extent and upon the length of the locking member.

The significance of the pivoting angle is that it determines the minimum theoretically possible angle between the length direction of the male member and the locking member when the same is in the closed or fastened position. The angle should be very small, since the locking member has to receive not only the longitudinal force operative on the male member but also — and as can readily be ascertained from the triangle of forces — the tongue force value multiplied by the factor $1/\cos\alpha$ of the pivoting angle. Such angle is 45° in known fastenings and so the factor is 1.4. In other words, the locking-member force is 40% more than the tongue force.

Reduction of the locking-member force is desirable not only for the sake of greater safety and lighter construction but also in order to reduce the forces required to open the lock under load. The strength and safety which are necessary set limits to reducing the extent to which the locking member needs to penetrate into the recessing in the male member, as a means of reducing the pivoting angle. Lengthening the locking member would be a means of reducing the pivoting angle; unfortunately, the locking member is required to be very short so that the elements operating it can work with a satisfactory mechanical advantage so as to reduce the forces required to operate the locking member.

It is an object of the invention to device a fastening of the kind described in which the angle between the direction of the locking member and the direction of the male member in the fastened position is smaller than in the known fastenings.

According to the invention, that side of the locking member which is near the male member includes with the length direction thereof, when the locking member is in its release position, an angle widening in the direction of introduction of the male member; and at least in the region where the relatively thick male member part disposed before the recessing passes by the locking member, the male member guide direction extends with a similar inclination and merges substantially with the length direction of the male member only shortly before reaching the locking position.

Consequently, the angle of pivoting of the locking member must be measured not from a direction parallel to the direction of male member length but from a direction varying in the opposite sense from the previously mentioned direction and being the direction of the locking member when the same is in its release position. The inclination of the locking member to the direction of male member length when in the locking position is smaller in proportion as the locking member when in its release position is inclined further away from the direction of male member length during the introduction or pushing-in of the male member. In other words, because of its inclined shape the male member approaches the locking member when being pushed in. The angle of inclination of the locking member to the direction of male member length can therefore be reduced considerably, possibly right down to zero. Conveniently, however, a reduced angle of inclination is retained in the locking position so that the opposite inclination of the locking member in the release position and the corresponding inclination of the male member during introduction may also be small. It is sufficient for the angle of inclination of the locking member to the direction of male member length to be less than 20°, preferably in the region of 10°, in the locking position. For an inclination angle $\alpha$ of 10° the force to be received by the locking member is not even as much as 2% above the longitudinal force associated with the male member.

The length of the inclined portion of the introduction or push-in path should correspond substantially to the length of the locking member. The inclination of such path should correspond approximately to the inclination of the locking member when the same is in its release position. In practice, the inclined portion of the push-in path is often shorter than locking-member length and the angle for the locking member is correspondingly steeper.

Conventionally, the male member has in its front part lateral inclined or bevelled surfaces to facilitate introduction into the female member. Such surfaces can be used according to the invention to provide the inclined guidance during pushing-in; the associated guide surface in the female member can simply take the form of a pin guided in the plates of the female member. Such pin can in the locking position cooperate with the surface which follows on from the inclined portion of the male member and which is parallel to the length thereof, in order to determine in the locking position the required direction of guidance for the male member, the latter direction corresponding substantially to the direction of male member length. It has previously been considered necessary to provide a large bearing area for the male member on that side of the female member which is remote from the locking member, since the locking member might apply considerable transverse forces to the male member. For a locking member angle of 45° the latter forces are exactly the same as the longitudinal forces of the male member, whereas for an angle of 10° the transverse forces are less than 20% of the longitudinal force.

So that the considerable lateral forces may be received, in the known lock the two plates hereinbefore referred to are devised integrally from a U-section member, the connecting web between the two plates serving as the surface via which the tongue bears on the locking member. However, this shaping has considerable disadvantages, since distortions often occur during the hardening of the plates and impair accurate registration of the guide recesses in the two plates. An alternative provided by the invention and made possible because of the relatively reduced lateral forces is to use two separate but identically stamped and identically hardened plates which need to be rigidly interconnected only in one place, more particularly in the place associated with the cord connection, while the locking members, pins or other items guided in the other recesses can be secured in the conventional plastics casing. This feature not only increases accuracy, with advantages for the safety and ease of operation of the fastening, but also simplifies construction and assembly. If further guide surfaces for the male member are required between the plates, such additional surfaces can be embodied by parts of the plastics casing which extend between the plates.

In the known fastening having the integral U-section plates, the ejector spring, which is a helical compression spring, is guided in a passage embodied by oppositely directed but identical and opposite recesses in the two plates. According to the invention, to obviate such recesses the two plates can be formed with two slot-like apertures whose edges serve to guide the spring. This feature enables the plates to be entirely plane.

To provide a considerable reduction in the friction arising when the fastening is released, that surface of the locking-member-receiving recesses in the plates where the locking member experiences the belt forces has a convex rounding or has a double inclination resembling a pitched roof, the locking member in one embodiment being adapted to pivot between its release position and its locking position on the "ridge" of such "roof" formed in one or the other of the facing surfaces of the locking member and the contiguous facing surface of the receiving recess while the opposing surface is planar. In other embodiments, one or the other of these facing surfaces are gradually convexly rounded. In any event, during the pivoting movement of the locking member, the faces mentioned have no sliding relative movement, rather there is a rolling or tilting movement.

In known fastenings of the kind mentioned, the locking-member surface cooperating with the male member is a stamped surface. The roughness of such a surface increases the forces required to release the belt or else entails expensive further processing. According to the invention, to obviate these disadvantages the locking member is an entirely prismatic steel member. This makes it possible to use drawn steel for the locking member, that surface thereof which cooperates with the male member being a drawn surface while the cut curfaces are the end surfaces which extend parallel to the plates. This prismatic steel member can be connected as required to lever arms for transmitting the release movement.

The invention will be described in greater detail hereinafter with reference to the drawings which show advantageous embodiments of the invention and in which:

FIGS. 1, 2 and 3 are sectioned views of the fastening, without the surrounding plastic casing and parallel to and between the plates;

FIG. 4 is a section on the line IV—IV of FIG. 1, and

FIG. 5 is a plan view of the fastening in the viewing direction of FIGS. 1 to 3, the plastics casing being shown in chain-dotted lines.

FIGS. 5, 7, 8 and 9 are partial sectional views of the fastening showing alternate embodiments of suitable structure for the facing surfaces of the locking member and the recess in which it operates.

Figure 6:
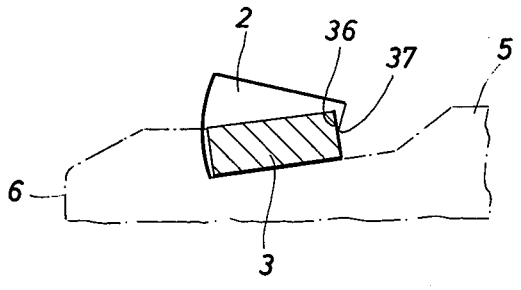

In FIGS. 1 to 3 only the most important operating elements are shown; they are a plate 1 (the lower plate in the viewing direction) formed with a recess 2 adapted to receive a locking member 3, a pin 4 and a male member 5. The chain-dotted lines denote surfaces of parts of a plastics casing which extend into the space between the plates and serve as additional guide surfaces for the male member 5. The additional guide surfaces can of course be embodied other than by projections of the plastics casing, as is known in the prior art.

Member 5 has a head 6 having bevelled surfaces 7. The same merge into parallel surfaces 8, behind which are set-back shoulders 9; the shoulders 9 cooperate with inclined surfaces 10 to form the recessings hereinbefore referred to. The surfaces 10 merge into inclined surfaces 11 which extend substantially parallel to the surfaces 7 and which merge into parallel surfaces 12 forming the transition to a belt buckle 13. The male member 5 is symmetrical of center-line 14; in the locked state shown in FIG. 1 the line 14 is also the center-line of the fastening and therefore the line of action of external forces acting on the fastening.

A spring (not shown) presses locking member 3 into the associated recess 9, 10 in member 5. The longitudinal force associated with the member 5 is transmitted via shoulder 9 to locking member planar end face 15, locking member rear surface 16 bearing on bearing surface 17 of the locking-member-receiving recess in the plates 1. In the case shown the surface 17 is slightly curved in a convex arc corresponding approximately to the angle of pivoting of the locking member. Consequently, in its pivoting movement the locking member rolls on surface 17 without rubbing.

Figure 7:
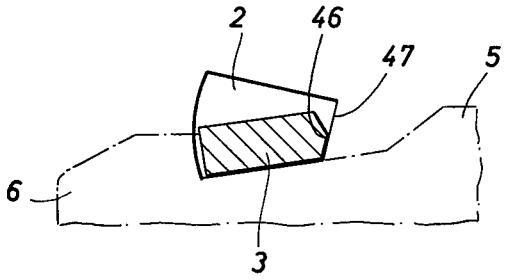
Figure 8:
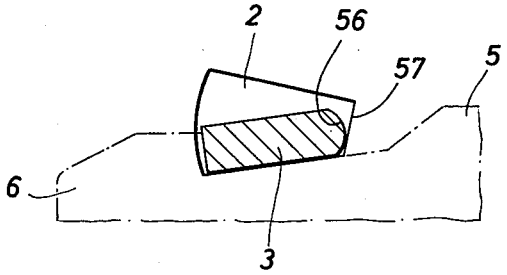
Figure 9:
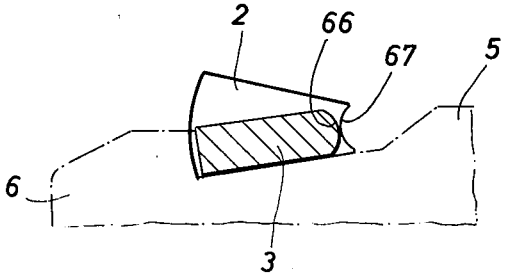

Other convex bearing configurations enabling a pivoting movement and having no or negligible relative sliding movement, are illustrated in the alternative embodiments of FIGS. 6, 7, 8 and 9. In FIG. 6, rear facing surface 36 of locking member 3 is planar and facing surface 37 of recess 2 includes a double inclined, "pitched-roof" bearing surface. one half of the surface 37 is arranged perpendicularly to the longitudinal direction of the locking member in its locking position shown. Thus the surface 36 and that half of surface 37 have a relatively large contact area which is advantageous in case of great locking forces. A further advantage of this embodiment is that the tilting point remains in the central region of the rear surface 36 of the locking member 3. This means that in tilting of the locking member 3 the end face 15 thereof may follow a circular path which has approximately the same direction as that end face 15, and consequently that the tilting movement doesn't necessitate any movement of the male member 5 to the left in the drawing, which movement would be necessary is the tilting point would be located outwardly from that central region. In FIG. 7, rear facing surface 46 of locking member 3 includes a double inclined, "pitched-roof" bearing surface and facing surface 47 of recess 2 is planar. In this connection it should be understood that surface 47 should be arranged approximately perpendicularly to the longitudinal direction of the locking member 3 and that the lower half ("lower" with regard to the drawing) of the reer surface 46 may be parallel thereto in the locking position of the locking member. Preferably, also in this embodiment the tilting point of the bearing surface of the locking member contacts the facing surface of the recess in the central region of the surface 46. In FIG. 8, rear facing surface 56 of member 3 is slightly curved in a convex are corresponding approximately to the angle of pivoting of the locking member and facing surface 57 of recess 2 is planar and preferably approximately perpendicularly to the locking direction of the locking member 3. Finally, in FIG. 9, rear facing surface 66 of member 3 is planar and facing surface 67 of recess 2 is slightly curved in a convex arc so that together they form a pivoting angle corresponding approximately to the angle of pivoting of the locking member.

In the locked or locking state shown in FIG. 1, the locking member 3 forms an angle $\alpha$ with the direction of male member and female member length and also with the direction of guidance of the male member 5 as determined by surface 8. The inclinations of the surfaces 9, 10 have the same angle or the complementary angle.

The recess 2 in plate 1 is V-shaped and therefore permits the locking member 3 to pivot into the release position visible in FIG. 3; the recess 2 is narrow enough near the surface 17 to provide adequate lateral guidance for the locking member 3. The same is oblong-shaped and its ends extend through identical levers 18 via which it can be operated for release against the spring biasing.

On that side of the female member which is near the locking member 3, head 6 of male member 5 bears by way of surface 8 on pin 4. Consequently, the direction in which head 6 is guided near its locking position coincides with center-line 14. Its surfaces 12 fit the chain-dotted additional guide surfaces well enough to preclude unwanted pivoting of the male member in the female member. The additional guide surfaces, which have the reference 19 on the side remote from the locking member 3, are set back from the pin 4 at least as far as the difference between the distances of the front part and rear part of the locking member from the center-line 14 when the locking member is in the release position (FIG. 3). There is at least enough space between the surface 19 and the rearward part of the locking member 3, such part facing the direction of introduction of the male member, for the head 6 thereof to pass through readily between the surface 19 and the last-mentioned part.

The sequence of events for introducing the male member into the female member proceeds as indicated by the stages or steps shown in FIGS. 2, 3 and 1. In FIG. 2 head 6 of member 5 slides by way of its surface 10 on the nearby part 20 of locking member 3, part 20 reducing the path of head 6. Consequently, as head 6 is introduced beyond the stage shown in FIG. 2, locking member 3 continues to be displaced until its side 20 extends substantially parallel to the center-line 14. The male member 5 can then be advanced further until its surface 7 abuts pin 4. So far the path of the male member 5 has been along a line 14' which can be seen in FIG. 2 and which is slightly offset from the center-line 14. When surface 7 has reached pin 4, further movement of head 6 is in the direction of line 14" shown in FIG. 3, the head pushing member 3 further in the release direction until the head surface 8 parallel to the direction of male member length reaches pin 4 and the center-line of the male member coincides with the center-line 14 of the female member. This is the stage shown in FIG. 3, where the locking member 3 can be seen in its extreme open or release position. The angle between the positions of the locking member 3 in FIGS. 1 and 3 is the angle of pivoting of the locking member.

Further introduction of the member 5 leads from the stage shown in FIG. 3, along the center-line 14, to the stage which is shown in FIG. 1 and in which the locking member 3 has engaged behind the head 6.

The surfaces 11, 12 are so disposed that the surface 11 helps correct adjustment of the male member 5 while surface 7 is sliding on pin 4. It is assumed that the surfaces 12 have reached the additional guide surfaces 19 approximately during the introduction stage shown in FIG. 3.

Removal of the male member 5 from the female member proceeds in the opposite direction through the agency of an ejector spring 21, visible only in FIG. 5 in the expanded state. Spring 21 operates after lever 18 visible in FIG. 5, has been turned clockwise to bring locking member 3 into the release position shown in FIG. 3. The rotation can be produced e.g. by means of a slider 22 which is shown in chain-dotted lines in FIG. 5 together with other items 23 of the plastics casing and which can be operated by the pressure of a thumb in the direction indicated by an arrow 24.

Spring 21 is guided in the two plates of the female member by edges 25 of two identical and flush recesses. The two plates are interconnected at a place 26 by means of a connecting member 27 which also ensures the required between-plates spacing. The locking member 3, pin 4 and any other inserts in recesses in the plates in the female member are located solely by the plastics casing 23.

While particular embodiments of the invention have been shown and described, it will be understood that the invention is not limited thereto, since modifications may be made and will become apparent to those skilled in the art.

What is claimed is:

1. A safety belt fastening comprising an elongate male member having a wide introduction head, a first lateral recess therebehind, and a shoulder between said introduction head and said first lateral recess substantially parallel to the insertion direction of said male member, two spaced apart plates joined to form a female member having a substantially straight side wall, the bore of said female member being adapted to receive said male member, said plates including therebetween at least one stationary guide surface means projecting into said bore from said side wall for guiding a cooperating side surface of said male member, at least one of said plates including a second lateral recess remote from said side wall, and a pivoted locking member retained within said second recess resiliently biased for engagememnt with said male member first lateral recess and pivoting within said second recess with the insertion of said introduction head between said guide surface means and said locking member as it is guided by said guide surface means, said guide surface means guiding said male member at least partially laterally from its primary insertion direction against said looking member to cause pivoting of said locking member within said second recess to its open release position, said locking member pivoting into its lock position into said first male member lateral recess with the passage of said male member introduction head past said locking member as said head is guided by said guide surface means, the end face of said locking member in its lock position being displaced longitudinally toward the entrance of said female member from said guide surface means.

2. A safety belt fastening in accordance with claim 1, wherein said pivoted locking member is pivoted open at least partially upwards from the primary insertion direction beyond a line parallel therewith.

3. A safety belt fastening in accordance with claim 1, wherein said guide surface means includes a surface substantially parallel with the insertion direction of said male member and a pin for moving said male member laterally for pivoting said locking member to its open release position.

4. A safety belt fastening in accordance with claim 1, wherein said locking member includes an elongate surface biased against said male member head aligned substantially parallel with the insertion direction of said male member during the time of insertion.

5. A safety belt fastening in accordance with claim 1, wherein said male member head includes an inclined bevelled side and wherein said guide surface means includes a pin for engaging said inclined bevelled side during male member insertion.

6. A safety belt fastening in accordance with claim 1, and including a plastic casing extending between said plates of the female member to form other guide means.

7. A safety belt fastening in accordance with claim 1, wherein said plates are substantially planar.

8. A safety belt fastening in accordance with claim 7, wherein said plates are jointed by rigid interconnection only at the junction of said plates with a cord associated therewith.

9. A safety belt fastening in accordance with claim 1, and including manually operable release means connected for pivotally rotating said locking member to its open release position.

10. A safety belt fastening in accordance with claim 9, and including an injector spring operating within a guide slot in at least one of said plates for ejecting said male member head.

11. A safety belt fastening in accordance with claim 1, wherein said second lateral recess includes a convexly rounded bearing surface for supporting tension forces applied to said male and female members of the fastening when said locking member is in its lock position and wherein the face of said locking member impinging on said bearing surface is either planar or convexly rounded.

12. A safety belt fastening in accordance with claim 1, wherein said second lateral recess includes a double-inclined, pitched-roof bearing surface for supporting tension faces applied to said male and female members of the fastening when said locking member is in its lock position and wherein the face of said locking member impinging on said bearing surface is in pivoting contact with said bearing surface.

13. A safety belt fastening in accordance with claim 1, wherein said locking member is entirely prismatic steel.

14. A safety belt fastening comprising an elongate male member having a wide introduction head and a lateral recess therebehind, two spaced apart plates joined to form a female member adapted to receive said male member, at least one of said plates including a plate recess, a pivoted locking member retained within said recess resiliently biased for engagement with said male member lateral recess, said locking member having a front face for locking engagement therewith, said locking member having a rear face pivotally supporting and in rolling contact with a supporting face in said plate recess, wherein said rear face and said supporting face are both convexly rounded or wherein one of said faces is convexly rounded and one is straight.

15. A safety belt fastening in accordance with claim 14, wherein said locking member has a rectangular cross section.

16. A safety belt fastening in accordance with claim 15, wherein said locking member is prismatically formed.

17. A safety belt fastening in accordance with claim 16, wherein said prismatically formed member is a section of drawn steel, the rear face thereof being formed by a drawn surface.

18. A safety belt fastening comprising an elongate male member having a wide introduction head and a lateral recess therebehind, two spaced apart plates joined to form a female member adapted to receive said male member, at least one of said plates including a plate recess, a pivoted locking member retained within said plate recess resiliently biased for engagement with said lateral recess, said locking member having a front end face for locking engagement with said male member lateral recess, said locking member having a rear face supported by a supporting face in said plate recess, wherein said rear face comprises a double-inclined, pitched-roof bearing surface, the inclined portions of which meet at a tilting point, and wherein the supporting face in said plate recess is a similar complementary double-included, pitched-roof bearing surface.

19. A safety belt fastening comprising an elongate male member having a wide introduction head and a lateral recess therebehind, two spaced apart plates joined to form a female member adapted to receive said male member, at least one of said plates including a plate recess, a pivoted locking member retained within said plate recess resiliently biased for engagement with said lateral recess, said locking member having a front end face for locking engagement with said male member lateral recess, said locking member having a rear face supported by a supporting face in said plate recess, wherein said rear face comprises a double-inclined, pitched-roof bearing surface, the inclined portions of which meet at a tilting point, and wherein said supporting face in said plate recess is planar and said tilting point meets said planar supporting face in its central region.

* * * * *